United States Patent [19]

Stanley

[11] 4,315,355

[45] * Feb. 16, 1982

[54] STRAND CRIMPING TREATMENT

[75] Inventor: Robert K. Stanley, Media, Pa.

[73] Assignee: Techniprises Limited, Douglas, Isle of Man

[ * ] Notice: The portion of the term of this patent subsequent to Jul. 31, 1996, has been disclaimed.

[21] Appl. No.: 61,007

[22] Filed: Jul. 26, 1979

Related U.S. Application Data

[63] Continuation-in-part of Ser. No. 809,992, Jun. 27, 1977, Pat. No. 4,162,564.

[51] Int. Cl.[3] ..... D02G 1/12; D02G 1/20

[52] U.S. Cl. ..... 28/251; 28/255; 28/267

[58] Field of Search ..... 28/251, 255, 264, 267

[56] References Cited

U.S. PATENT DOCUMENTS

| | | | |
|---|---|---|---|
| 3,166,821 | 1/1965 | Furlong | 28/251 |
| 3,461,521 | 8/1969 | Eskridge et al. | 28/267 X |
| 3,644,969 | 2/1972 | Guillermin et al. | 28/255 |
| 3,751,778 | 8/1973 | Grosjean et al. | 28/255 |
| 4,162,564 | 7/1979 | Stanley | 28/255 X |

FOREIGN PATENT DOCUMENTS

| | | | |
|---|---|---|---|
| 2524709 | 11/1976 | Fed. Rep. of Germany | 28/264 |
| 45-9148 | 4/1970 | Japan | 28/264 |
| 1161674 | 8/1969 | United Kingdom | 28/255 |

*Primary Examiner*—Robert Mackey
*Attorney, Agent, or Firm*—Charles A. McClure

[57] ABSTRACT

Textile strands are dyed while being bulked or crimped by lengthwise compression. The dyestuff advantageously is supplied in finely divided liquid or preferably solid form and is injected, as by aspiration or by positive pressure methods, into fluid hot enough to vaporize it before such fluid together with such dyestuff comes into contact with strand so treated. Such strand, forwarded with or by flow of hot propellant fluid into a foraminous region in which the strand is confined laterally but from which the fluid may escape except where the strand is compressed into a compact mass, is exposed to the dyestuff by permeation with such fluid. Lateral escape of the propellant fluid is effected, preferably before such exposure, and is utilized to control an operating condition, such as temperature of strand input into and/or speed of removal of strand from the chamber, for improved uniformity of dyeing and bulking or crimping of the strand.

8 Claims, 7 Drawing Figures

STRAND CRIMPING TREATMENT

This is a continuation-in-part of my copending application, Ser. No. 809,992 filed June 27, 1977, now U.S. Pat. No. 4,162,564.

This invention relates to dyeing of funicular textile material together with bulking or crimping thereof, usually called herein textile strands or simply strand(s), and concerns particularly means and methods for attaining uniformity of such treatment and of products thereof, especially at high processing speeds.

With increasing operating speed, processes of intentional distortion of textile strands, as to impart bulk or crimp thereto, become subject to temperature limitations. A resulting tendency to soften, fuse, or degrade is aggravated in thermoplastic strand compositions by a correlative reduction in time available for heat transfer to, from, or within the strand at rapid transport rates.

Many methods of intentional distortion, especially of the axial configuration, of textile strands have been devised, especially for those of thermoplastic composition, such as nylon, polyester, polyalkylene, and the like. Most of such methods were intended to bulk or crimp the strand to give it more visible "cover" or more desirable "handle" than was present in the strand material as produced. Additionally, such methods were developed or modified so as to increase processing conditions, such as speed or throughput, and to improve product characteristics such as uniformity in the degree of resulting crimp or dispersion in crimp orientation, etc.

Longitudinally compressive crimping is one of the most successful methods of treating textile strands to accomplish such purposes. However, roll feeding of strands into laterally confining chambers for such crimping is conducive to localized overheating of the uncrimped strand and consequent non-uniformity of the crimped strand. Fluid-jet feeding is hampered by low heat transfer rates and by increasingly difficult control of back pressure or compressive impedance of the strand with fluid propulsion at high speeds.

Bulking or crimping of textile strands often reduces their amenability to dyeing or renders them incapable of being dyed evenly or uniformly. Pre-dyed strands often suffer reduced color level and may develop streaks or other non-uniformity in appearance when bulked or crimped. However, no practical method of combined dyeing and bulking/crimping has been developed—in large part because of the difficulty of obtaining even dyeing under conditions severe enough to effect desired configurational modification of a textile strand.

A primary object of the present invention is improved jet-stuffer-crimping of funicular textile material or textile strands.

Another object of this invention is high-speed dyeing of textile strands during such processing thereof.

A further object of the invention is control of such strand processing to render it self-regulating.

Other objects of the present invention, together with means and methods for attaining the various objects, will be apparent from the following description and the accompanying diagrams of the invention, which are presented by way of example rather than limitation.

In general, the objects of the present invention are accomplished, in compressive crimping of funicular textile material, propelled lengthwise and accompanied by flow of propellant fluid, into a first laterally confining region wherein the propelled textile material accumulates temporarily as a compressed mass in a downstream portion of the region, and at least some such fluid diffuses laterally from a portion of the confining region, and sensing of such lateral outflow is utilized to control the travel of the textile material. Such textile material is forwarded from the leading edge of the compressed mass, thence into a second laterally confining region wherein the accumulation of compressed textile material in the region is permeated by treating fluid, preferably bearing dyestuff to dye the strand.

Thus, in apparatus for such crimping, the invention comprises means for providing a first laterally confining region and a second laterally confining region, propulsion means for transporting textile strand from the first such region to the second such region, and means for circulating a dyestuff-bearing fluid through a mass of the textile material while confined in the second region. Such means may comprise speed-control means or temperature control means, as well as appropriate chambers, nip rolls, fluid conduits, etc.

Figure 1:
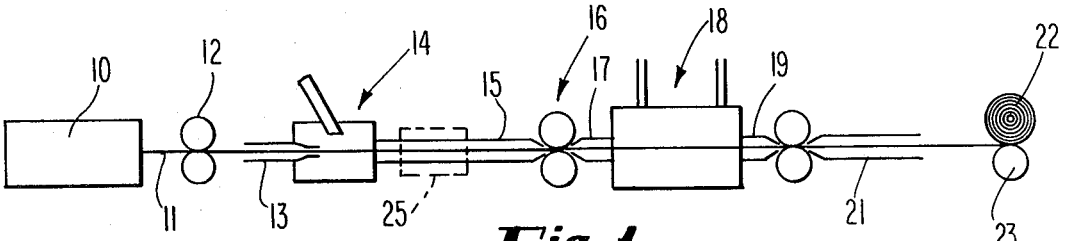
FIG. 1 is a simplified schematic diagram of the treatment of textile strand material according to this invention.

FIG. 1 shows in simplified schematic form textile strand 11 supplied from source 10. The source may comprise an extruder of a fiber-forming composition into a multiplicity of filaments subsequently gathered into a bundle or strand, drawn to permanently increased length, and withdrawn from godets or other roll arrangements or other forwarding means. Alternatively, the source may comprise a package of previously extruded but undrawn multifilament strand plus a suitable drawing system, or may comprise a package of drawn multifilament strand. Pair of nip rolls 12 withdraw the strand from the source and control its rate of entry into and travel through inlet tube 13 and jet means 14 and into laterally confining stuffing chamber means 15—part of which, including that portion surrounded by sensing means 25 (shown in broken lines), is foraminous. The openings (not visible here) in the foraminous part of chamber means 15 are large enough to permit ready escape of the fluid used as a propellant in the jet but small enough to preclude admitting or abrading a filament of the strand. A pair of godet rolls or other forwarding means may be used to withdraw the strand from its source.

From the stuffing chamber the strand in compressed form (not shown as such) is withdrawn by pair of nip rolls 16 and is fed thereby via entrance fitting 17 into a succeeding treating chamber (not visible), part of which may be foraminous and/or jacketed to permit introduction of treating fluid thereinto to permeate the compressed strand accumulation. The treating fluid conveniently carries dyestuff introduced thereinto at an earlier stage. Fluid transport means 18 surrounds the treating chamber and provides an entry and exit for such treating fluid. Pair of nip rolls 20 (see also FIGS. 2 and 6) forward the treated compressed strand from exit fitting 19 immediately downstream of the treating chamber into outlet chamber 21 from which it is wound up (or alternatively, forwarded further) lengthwise in strand form as onto package 22 driven by roll 23, which may be of self-traversing type.

Figure 2:
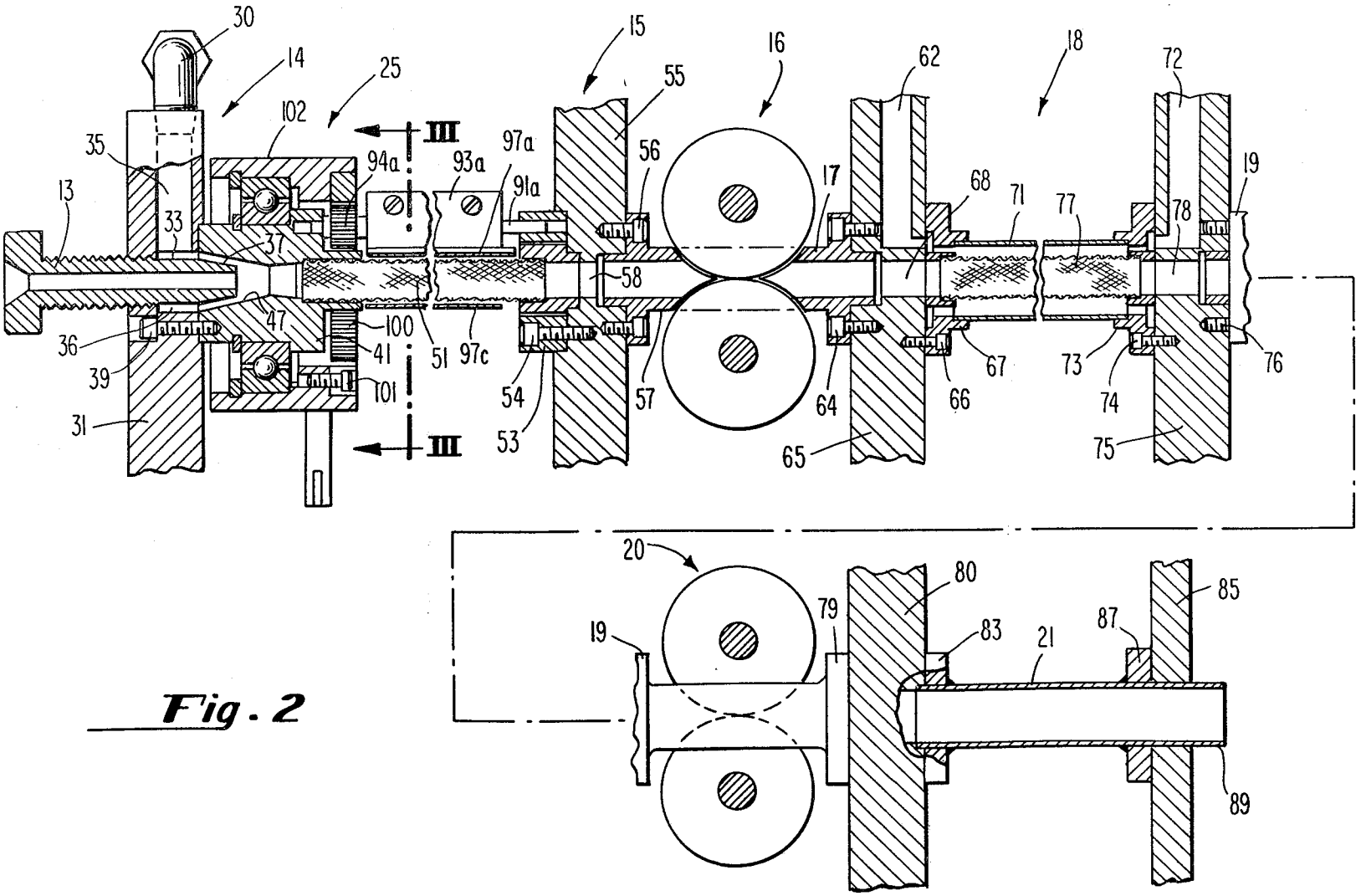
FIG. 2 is a side sectional elevation of apparatus for so treating textile strands.

FIG. 2 shows in longitudinal section and considerably greater detail (and appropriate modification) apparatus shown schematically in the preceding view, excluding the source and windup means and with strand 11 omitted in the interest of clarity. Inlet tube 13 is shown threaded into first support plate 31, which is hollowed out by vertical bore 35 and adjoining annular space 36 around cylindrical end portion 33 of the tube. The support plate forms part of jet means 14 together with fluid tube 30, which discharges into vertical bore 35. Tapered downstream or exit end 37 of the inlet tube for the strand is located within similarly tapered frustoconical inlet portion 47 of jet housing 41 secured (as by screws 39, one shown) to the first support plate. The upstream or strand inlet end of foraminous inlet tube 51 of stuffing chamber means 15 fits into the jet housing, which tapers outwardly to receive complementarily tapered exit end 37 of the strand inlet tube. The other or downstream end of this foraminous tube fits into a first annular stuffing chamber support piece 53 secured (as by screws 54, one shown) to support plate 55 of stuffing chamber means 15. Second annular stuffing chamber support piece 57, which forms solid-walled downstream portion of the chamber itself, is similarly secured to second support plate 55 (as by screws 56, two shown) opposite the first support piece and axially aligned therewith but with their adjacent ends spaced apart by intervening hollow 58 in the plate. The tapered downstream end of stuffing chamber support piece 57 fits into the upstream nip or bight of withdrawal roll pair 16 (enclosed laterally as indicated in broken lines).

Fitting similarly into the downstream nip of withdrawal roll pair is the tapered upstream end of treating chamber entrance fitting 17, whose flanged opposite or downstream end is secured (as by screws 64, two visible) to a third support plate 65. Second annular treating chamber support piece 67 is secured (as by screws 66, one shown) to the downstream side of this last support plate 65 and receives the upstream end of foraminous part 77 of the treating chamber as well as the upstream end of surrounding jacket 71. The downstream ends of these respective tubular members are retained in third annular support piece 73 secured (as by screws 74, one shown) to fourth support plate 75 for the treating chamber. Treating chamber exit fitting 19 is secured similarly (by screws 76) at its flanged upstream end to support plate 75, with its tapered downstream end fitting into the upstream nip of forwarding roll pair 20. Fitting similarly into the downstream nip of the same pair of rolls is tapered upstream end of outlet tube entrance fitting 79, whose flanged downstream end is secured to fifth support plate 80. Annular outlet first support piece 83 is secured to the downstream side of fifth support plate 80 and receives the upstream end of outlet tube 21, whose downstream end is secured similarly by annular outlet second support piece 87 to sixth support plate 85, through which the outlet tube passes and then terminates in open downstream end 89.

Figure 3:
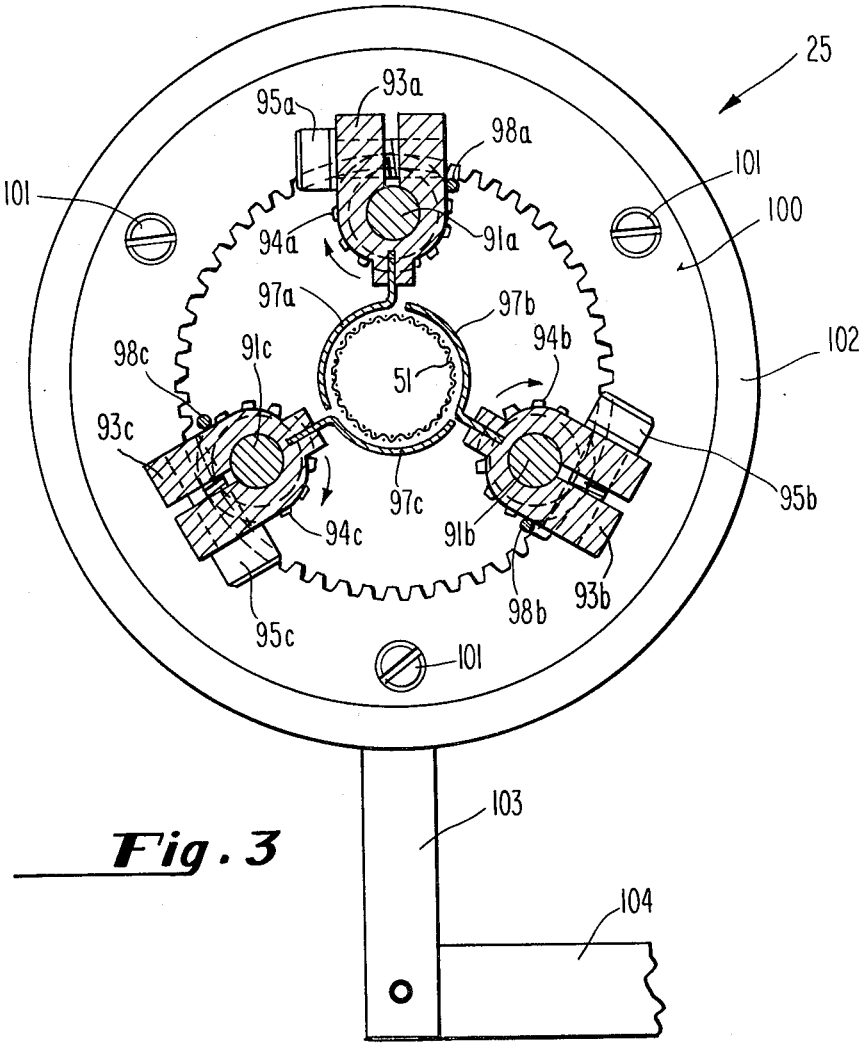
FIG. 3 is a transverse sectional elevation of part of such apparatus, taken at III—III on FIG. 2.
Figure 4:
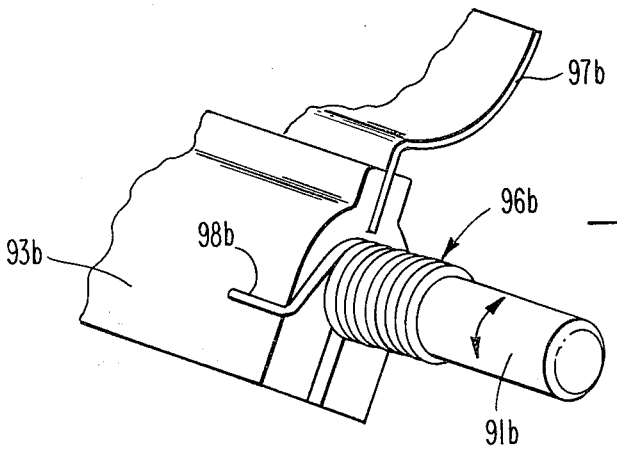
FIG. 4 is a perspective view of part of the apparatus of FIG. 3.

Located between the first and second support plates and generally surrounding the foraminous portion of the stuffing chamber is sensing means 25, indicated schematically in broken lines 3 in FIG. 2 but shown enlarged and in detail in FIGS. 3 and 4. Three axles **91*a*, 91*b*, 91*c* are journaled at the left end in housing 41 of jet means 14 and at the right end in second support plate 55, equidistant in radius and arc about the axis of foraminous inlet tube 51 of stuffing chamber 15. Clamped to the respective axles are U-shaped holders 93*a*, 93*b*, 93*c* with bolts 95*a*, 95*b*, 95*c* holding their respective pairs of arms together about the intervening axles. Vane 97*a* is secured in a slot in the bight of U-shaped holder 93*a* oriented toward the chamber axis with the body of the vane curved arcuately about and in close proximity to the foraminous inlet tube for the strand, as shown most clearly in FIG. 3. Vanes 97*b* and 97*c* are supported similarly by the other holders and are positioned similarly, each holder being spring-biased into such closed position as shown most clearly in FIG. 4. Thus, holder 93*b* for vane 97*b* has biasing spring 96*b* wrapped around axle 91*b* with end 98*b* of the spring contiguous with the near side of the holder (and the other end, not visible, secured to the axle, as by terminating in a radial bore therein or by a screw, etc.). Each holder may rotate clockwise from the closed position through a limited arc as suggested by the arrows juxtaposed thereto in FIG. 3 and the double-headed arrow for the partly rotated holder in FIG. 4**.

Further details of the sensing means appear in FIG. 2, where only holder **93*a* is shown. The left end of axle 91*a* has pinion gear 94*a* affixed thereon in engagement with ring gear 100, which surrounds the set of three like gears (only one shown here) carried by the respective holder axles. The ring gear is affixed (as by screws 101, one visible) to cup-shaped member 102, which surrounds jet housing 41 and is spaced thereupon so as to be able to rotate to and fro thereabout. Depending from the latter member, to which it is affixed, is sensing arm 103 (See also FIG. 3). Control arm 104 (FIG. 3) is pinned pivotally thereto, and its utility is described below. Engagement of the ring gear and pinion gears (94*a, b, c***) is indicated by pair of concentric circular broken lines, partly concealed behind the vane holders. As is explained more fully below, diffusion of fluid propellant through the foraminous wall portion of the stuffing chamber forces the vanes outward, rotating them and their gears and thereby rotating the surrounding ring gear and the attached control arm.

Figure 5:
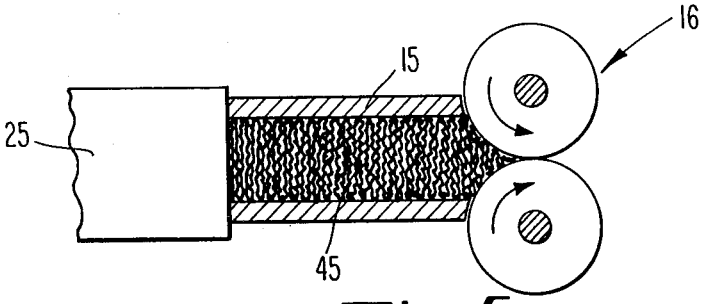
FIG. 5 is a somewhat schematized sectional view of a portion of the foregoing apparatus with a compact body of textile strand therein.

FIG. 5 shows schematically the non-foraminous wall portion of stuffing chamber 15, downstream from sensing means 25 and the foraminous wall portion surrounded thereby. This downstream part of the stuffing chamber is sectioned to reveal compact mass 45 of strand longitudinally compressed and buckled into crimped configuration. Although rolls 16 withdraw the strand from the chamber in such compressed form (and feed it simultaneously into the succeeding chamber—not shown in FIG. 5) a length of such strand released from such confinement (and preferably stabilized as described below) would be characterized in appearance by combined angular and curvilinear distortion of the component filaments from rectilinearity—similar to—but non-identical with one another, endowing the entire strand with overall uniformity in conjunction with an optimal range of crimp configuration.

It will be understood that such compact mass (45) of the compressed strand greatly hinders flow of propellant fluid downstream along the chamber axis. Accordingly, such fluid tends to diffuse radially outward through the upstream foraminous wall portion (51, see FIG. 2). Such radial diffusion is hindered somewhat by the vanes closely surrounding the chamber wall, but the more compact the strand downstream becomes the stronger the force of radial diffusion, thereby forcing the vanes apart or open. Such movement of the vanes moves the attached sensing arm (103) by turning the ring gear (100) through rotation of their pinion gears engaged therewith. Resulting movement of the attached control arm (104) is utilized in one or more ways to counteract the buildup of the compact mass and, thus, reduce the radial diffusion and concomitant arm movement, as shown in the succeeding views.

Figure 6:
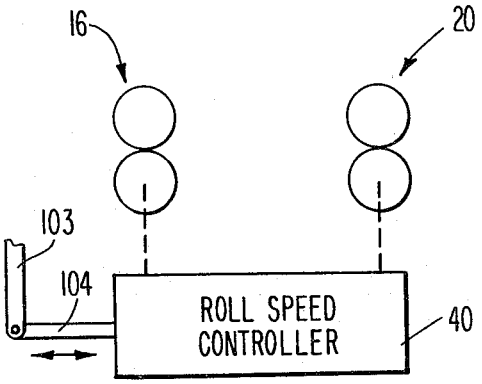
FIG. 6 is a schematic, partially block, diagram of one type of control according to the invention.

FIG. 6 shows Roll Speed Controller 40 (in block form) connected mechanically (broken lines) to respective roll pairs 16 and 20. Control arm 104 enters the controller and connects to any suitable element therein for increasing and decreasing the roll speed. The controller may comprise a conventional positive infinitely variable drive, and it is connected so that upon increased arm throw, the speed of both sets of rolls increases to increase the rolls speeds (usually proportionately although different in the respective pairs). Such increase in strand removal rate, if well proportioned to the crimping rate, as may be desired by routine adjustment of the drive, will relieve the radial outflow accordingly. The compressed textile material is forwarded from the leading edge thereof out of the compression region at a rate commensurate with the extent of accumulation. The effecting of desired negative feedback action is apparent.

Figure 7:
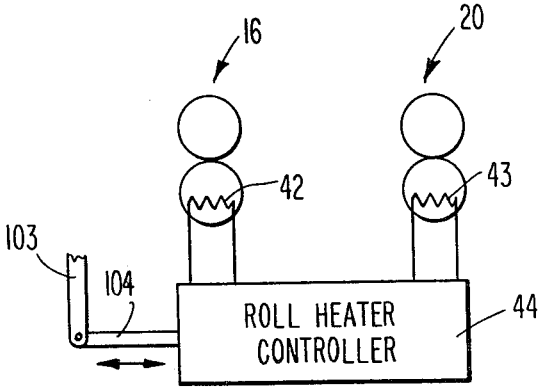
FIG. 7 is a similar schematic diagram of another type of control thereby.

Alternatively, as shown schematically in FIG. 7, a roll in each such roll pair may have a heating element associated therewith: e.g., electrical resistance heater 42 in one of rolls 16, and similar heater 43 in one of rolls 20. Control arm 104 affects Roll Heater Controller 44 (shown in block form) to reduce the heating temperature as the radial diffusion increases so as to reduce the tendency of the strand to deform into a tightly compact mass, and to increase the heating temperature to foster deformation into a more compact mass as the radial diffusion means and the vanes move back to enclose the foraminous chamber wall.

Once uniformly compressed in and forwarded out of the first laterally confining chamber into the subsequent laterally confining treating chamber, the textile material is in condition for treatment, preferably including dyeing, according to this invention. Either passageway 62 or 72 may constitute an inlet, and the other an outlet, for the treating fluid, usually comprising steam or at least hot air. Injection of such fluid through passageway 72 and out through passageway 62 provides countercurrent exposure of the textile material, as the treating fluid passes through foraminous part of the screen defining treating chamber located inside jacket 71. This is conducive to even exposure of the strand to the treating fluid including the dyestuff. The speed of rolls 20 at the exit end of the treating chamber may be adjusted relative to that of rolls 16 at the entrance end. At high humidity, attainable by application of steam or finely divided water droplets or fog, cellulose strands tend to expand and polyolefin strands to contract, while the various nylons react variously, and the ratio of roll speed out to roll speed in should be adjusted appropriately.

Additional advantages and benefits of this invention will become readily apparent to those persons who undertake to practice it in the light of this specification. Both speed control and temperature control of strand-feeding or forwarding rolls may be employed according to this invention. Further chambers (and nip rolls) may be added, if desired, to aid the reconversion of the crimped strand from a compact mass to longitudinal form suitable for winding, and roll speed may be raised as the strand proceeds downstream to aid therein.

Notwithstanding the illustration and description of certain embodiments of the present invention, modifications may be made therein, as by adding, combining, or subdividing parts or steps, or by substituting equivalents, while maintaining all or some of the advantages and benefits of this invention, which itself is defined in the following claims.

The claimed invention is:

1. In compressive crimping of funicular textile material propelled lengthwise and accompanied by flow of propellant fluid into a first laterally confined region, wherein propelled textile material accumulates temporarily as a compressed mass in a downstream portion of the region, and at least some such fluid diffuses laterally from a portion of the region unoccupied by the compressed mass, the improved comprising utilizing positive lateral diffusion of such fluid to control the accumulation of compressed textile material in the region by controlling the rate of forwarding of such textile material out of the region, including the step of forwarding the textile material from the leading edge thereof at a rate commensurate with the extent of accumulation of the compressed mass of textile material in the region, into a separate treating region, confining the textile material temporarily in the separate region with dyestuff present therein, for fluid treatment therein, injecting treating fluid into the latter region, and thereby dyeing the textile material.

2. Compressive crimping of funicular textile material according to claim 1, including the step of adjusting the rate of forwarding thereof out of such first region, increasing the rate at increased lateral outflow of diffusion fluid to remove the textile material more rapidly as it tends to accumulate more extensively in the region and thereby block flow of fluid downstream therethrough, and decreasing the rate to remove the textile material less rapidly as it tends to accumulate less extensively in the region and thereby allow flow of fluid downstream, then forwarding it directly into the separate treating region.

3. Compressive crimping of funicular textile material according to claims 1 or 2, wherein the treating fluid bears the dyestuff into the latter region.

4. A jet stuffer crimper comprising laterally confining means for receiving and temporarily accumulating funicular textile material therein, an upstream portion of the confining means being foraminous and thereby adapted to permit propellant fluid to diffuse laterally therefrom, means for forwarding textile material from the leading edge of an accumulation thereof and out of the confining means, and movable sensing means for sensing lateral diffusion of propellant fluid from the confining means and including a plurality of vanes pivotally mounted about the foraminous portion of the confining means, means biasing the vanes to inhibit diffusion of the fluid therefrom, means for controlling the speed at which the forwarding means removes textile material from the confining means, and control linkage between the deflectable vanes and the speed-control means interconnected so that increased deflection of the vanes increases the forwarding speed, and a laterally confining treatment chamber having an entrance downstream from the forwarding means, variable-speed means for taking up textile material from the treatment chamber, and control linkage between the deflectable vanes and the variable-speed means interconnected so that increased deflection of the vanes increases the takeup speed.

5. Jet stuffer crimper according to claim 4, wherein the treatment chamber is foraminous, and including means for injecting treatment fluid including dyestuff into the chamber.

6. Jet stuffer crimper according to claim 4, including a plurality of laterally confining treatment chambers arranged to receive the textile material in sequence, including at least one foraminous chamber.

7. Jet stuffer crimper according to claim 6, wherein such foraminous laterally confining treatment chamber has a surrounding jacket having an inlet and an outlet for treating fluid.

8. Apparatus for stuffer crimping and dyeing funicular textile material, wherein such material is forced together with propellant fluid into the inlet end of a laterally confining crimping chamber in which it buckles into compact crimped configuration, is accumulated temporarily therein, and is withdrawn subsequently from the opposite outlet end thereof, comprising a foraminous portion of the laterally confining chamber upstream of the outlet end and spaced therefrom by a non-foraminous downstream portion of the laterally confining chamber, vane means biased to cover the foraminous portion and deflectable outward therefrom by lateral diffusion of propellant fluid out of the chamber when the flow thereof downstream and out of the outlet end is restricted by compaction of yarn in the downstream portion, variable-speed means for withdrawing the compacted crimped yarn from the chamber through the outlet, and means interconnecting the vane means and the withdrawal means to withdraw the yarn faster the more the vane means is deflected outward by laterally diffusing propellant fluid, and a laterally confining treatment chamber located downstream of the withdrawal means to receive crimped textile material withdrawn from the crimping chamber, and means for injecting treating fluid including dyestuff into the treatment chamber and into crimped yarn therein.

* * * * *